US007637589B2

(12) United States Patent
Nakano et al.

(10) Patent No.: US 7,637,589 B2
(45) Date of Patent: Dec. 29, 2009

(54) CARRIAGE DEVICE AND RECORDING APPARATUS

(75) Inventors: Yosuke Nakano, Suwa (JP); Satoshi Negishi, Shiojiri (JP); Katsumi Okuhara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 410 days.

(21) Appl. No.: 11/767,132

(22) Filed: Jun. 22, 2007

(65) Prior Publication Data

US 2007/0296776 A1 Dec. 27, 2007

(30) Foreign Application Priority Data

Jun. 22, 2006 (JP) ..... 2006-173001

(51) Int. Cl.
*B41J 23/00* (2006.01)

(52) U.S. Cl. ..... 347/37; 347/50; 347/86

(58) Field of Classification Search ..... 347/37, 347/49, 50, 58, 59, 86, 108
See application file for complete search history.

(56) References Cited

U.S. PATENT DOCUMENTS 5,907,341 A * 5/1999 Miyazawa ..... 347/86
6,659,591 B2 * 12/2003 Sato et al. ..... 347/50

FOREIGN PATENT DOCUMENTS

JP 11-073748 3/1999
JP 2000-150032 5/2000
JP 2000-299167 10/2000
JP 2002-216303 8/2002
JP 2004-358912 12/2004

* cited by examiner

*Primary Examiner*—Thinh H Nguyen
(74) *Attorney, Agent, or Firm*—Workman Nydegger

(57) ABSTRACT

A carriage device includes a circuit substrate having a conductive connection portion, a connector having a plurality of contact arms, a connector holder in which the circuit substrate and the connector are installed, and a carriage in which a recording head unit is built and an ink cartridge having a conductive connection portion is housed and to which the connector holder is attached with both ends of the connector holder held, wherein contact terminals of the plurality of contact arms of the connector elastically contact the conductive connection portion of the circuit substrate and the conductive connection portion of the ink cartridge which are respectively disposed on both sides of the connector so as to electrically conduct between the circuit substrate and the ink cartridge, wherein a back side support member contacting the circuit substrate for regulating deformation of a face of the circuit substrate on the basis of the elastic contact is provided in the carriage, and wherein a deformation preventing support member is formed on a side opposite a side, on which the circuit substrate is installed, of the connector holder and the deformation preventing support member is configured to be able to contact a supported portion formed inside of the carriage.

7 Claims, 7 Drawing Sheets

CARRIAGE DEVICE AND RECORDING APPARATUS

BACKGROUND

1. Technical Field

The present invention relates to a carriage device implementing electrical conduction between an ink cartridge and a circuit substrate by using a connector for reading information on an ink cartridge housed in a carriage through the circuit substrate and a recording apparatus having the cartridge device.

In addition, the invention relates to a liquid ejecting apparatus such as an ink jet recording apparatus performing recording (ejecting liquid) on a recording medium (liquid ejecting medium) by ejecting (discharging) liquid such as ink from its head.

Here, the term "liquid ejecting apparatus" is used for referring not only to a recording apparatus, such as a printer, a copier, or a facsimile machine, having an ink jet recording head for ejecting ink from the recording head so as to perform recording on a recording medium but also to an apparatus that causes liquid to adhere onto a medium, corresponding to the recording medium in the above-described recording apparatus, by ejecting liquid selected depending on the use of the apparatus in place of ink onto the medium from a liquid ejecting head corresponding to the above-described ink jet recording head.

Examples of the liquid ejecting head other than the recording head described above are a color-material ejecting head that is used for manufacturing a color filter for liquid crystal displays or the like, an electrode material (conduction paste) ejecting head that is used for forming an electrode in an organic electroluminescent (EL) display, a field emission display (FED), or the like, a bioorganic compound ejecting head that is used for manufacturing bio-chips, and a sample spraying head as a precision pipette.

2. Related Art

In JP-A-2004-358912, there is disclosed technology in which a head cartridge can be attached/detached to/from an ink tank that can be attached/detached to/from a carriage of a printer apparatus, the printer apparatus having a memory device and a circuit substrate that is connected to an electrical contact terminal disposed in the carriage, the circuit substrate connected to the memory device of the ink tank being configured so as to be fixed to the electrical contact terminal disposed in the circuit substrate, and a part of a support member of the electrical contact terminal being fixed to an area surrounded by a plurality of fixing units of the circuit substrate.

However, in the technology described above, although deformation of the circuit substrate toward a side opposite an ink tank side can be regulated, there is a possibility that the circuit substrate is deformed so as to be bent toward the ink tank side. In a case where the ink tank is replaceable in the ink cartridge, when the circuit substrate is deformed so as to be bent toward the ink cartridge side, a part of the ink cartridge collides with the circuit substrate when installing the ink cartridge, and whereby the ink cartridge cannot be set to a predetermined position.

In addition, when the circuit substrate is deformed, contact pressure between a contact terminal of a connector and a conductive connection portion of the ink cartridge side and a conductive connection portion of the circuit substrate side changes, and accordingly, there is a possibility that information on the ink cartridge cannot be correctly transferred to the circuit substrate side due to generation of non-conductive spots.

SUMMARY

An advantage of some aspects of the invention is that it provides a carriage device, a recording apparatus, and a liquid ejecting apparatus capable of preventing deformation of a circuit substrate and a connector holder holding the circuit substrate even in a case where pressure is applied to the circuit substrate.

According to a first aspect of the invention, there is provided a carriage device including: a circuit substrate having a conductive connection portion; a connector having a plurality of contact arms; a connector holder in which the circuit substrate and the connector are installed; and a carriage in which a recording head unit is built and an ink cartridge having a conductive connection portion is housed and to which the connector holder is attached with both ends of the connector holder held. Contact terminals of the plurality of contact arms of the connector elastically contact the conductive connection portion of the circuit substrate and the conductive connection portion of the ink cartridge which are respectively disposed on both sides of the connector so as to electrically conduct between the circuit substrate and the ink cartridge. A back side support member contacting the circuit substrate for regulating deformation of a face of the circuit substrate on the basis of the elastic contact is provided in the carriage. A deformation preventing support member is formed on a side opposite a side, on which the circuit substrate is installed, of the connector holder and the deformation preventing support member is configured to be able to contact a supported portion formed inside of the carriage.

A force for bending the circuit substrate outward applied at a time when each contact terminal of the connector tightly contacts the conductive connection portion of the ink cartridge side and the conductive connection portion of the circuit substrate is suppressed by the bottom support member. As a counteraction thereof, the connector holder tends to bend to the ink cartridge side.

In the first aspect of the invention, since the deformation preventing support member contacts the supported portion, the connector holder can maintain its original form continuously without being bent toward the ink cartridge 5 side. Therefore, deformation of the circuit substrate on the basis of the deformation of the connector holder can be suppressed, and accordingly, it is possible to maintain a status of excellent connection between the contact terminals and the conductive connection portions.

In particular, when the ink cartridge is in a detached status, elastic contact between the conductive connection portion of the ink cartridge and the connector disappears, and thus, a force for reducing the deformation of the connector holder to the ink cartridge side disappears from that portion. In the aspect of the invention, even in such a case, the deformation of the connector holder is suppressed by using a structure for bring the support portion into contact with the supported portion. Therefore, the technical aspect of the invention is very important.

According to a second aspect of the invention, in the carriage device according to the first aspect of the invention, the deformation preventing support member is formed in a convex portion, which is provided in a part having a large deformation amount, in a width direction of the connector holder.

In this case, the structure of the carriage device is simplified with the advantages of the first aspect of the invention acquired.

According to a third aspect of the invention, in the carriage device according to the first aspect of the invention, the recording head unit is provided with a head portion having a nozzle array for ejecting ink and a head base body having a position determining portion to which the head portion is fixed and at which an outlet portion of the ink cartridge is set and positioned and a wall portion partitioning the position determining portion of the head base body is configured to serve as the supported portion.

In this case, since both faces of the wall portion partitioning the position determining portion of the head base body performs a position determining function of the ink cartridge and a deformation preventing function of the connector holder, the contact distance and contact pressure between the conductive connection portion of the ink cartridge and the connector can be adjusted with high precision. In addition, there is no need for forming a new supported portion inside the carriage.

According to a fourth aspect of the invention, in the carriage device according to the third aspect of the invention, the recording head unit is fastened to be fixed to the carriage through an outer base body portion located in the outside of the wall portion of the head base body and the connector holder is configured to be positioned above the outer base body portion inside the carriage.

In this case, the recording head unit and the connector holder are configured to be assembled together so as to overlap each other in an assembly direction, whereby it is possible to decrease a size of the assembled carriage in the depth direction.

According to a fifth aspect of the invention, there is provided a recording apparatus including a transport unit transporting a recording medium and a recording unit performing recording on the recording medium that is transported by the transport unit. The recording unit includes a carriage device having a carriage that reciprocates in a main scanning direction which is perpendicular to a transport direction of the recording medium, and the carriage device is the carriage device according to the first aspect of the invention.

In this case, since an electrical contact defection on the basis of deformation of the connector holder can be prevented and a status of excellent connection between the contact terminals and the conductive connection portions can be maintained, an incorrect recording operation due to unrecognizability or incorrect recognition of information on the ink cartridge can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
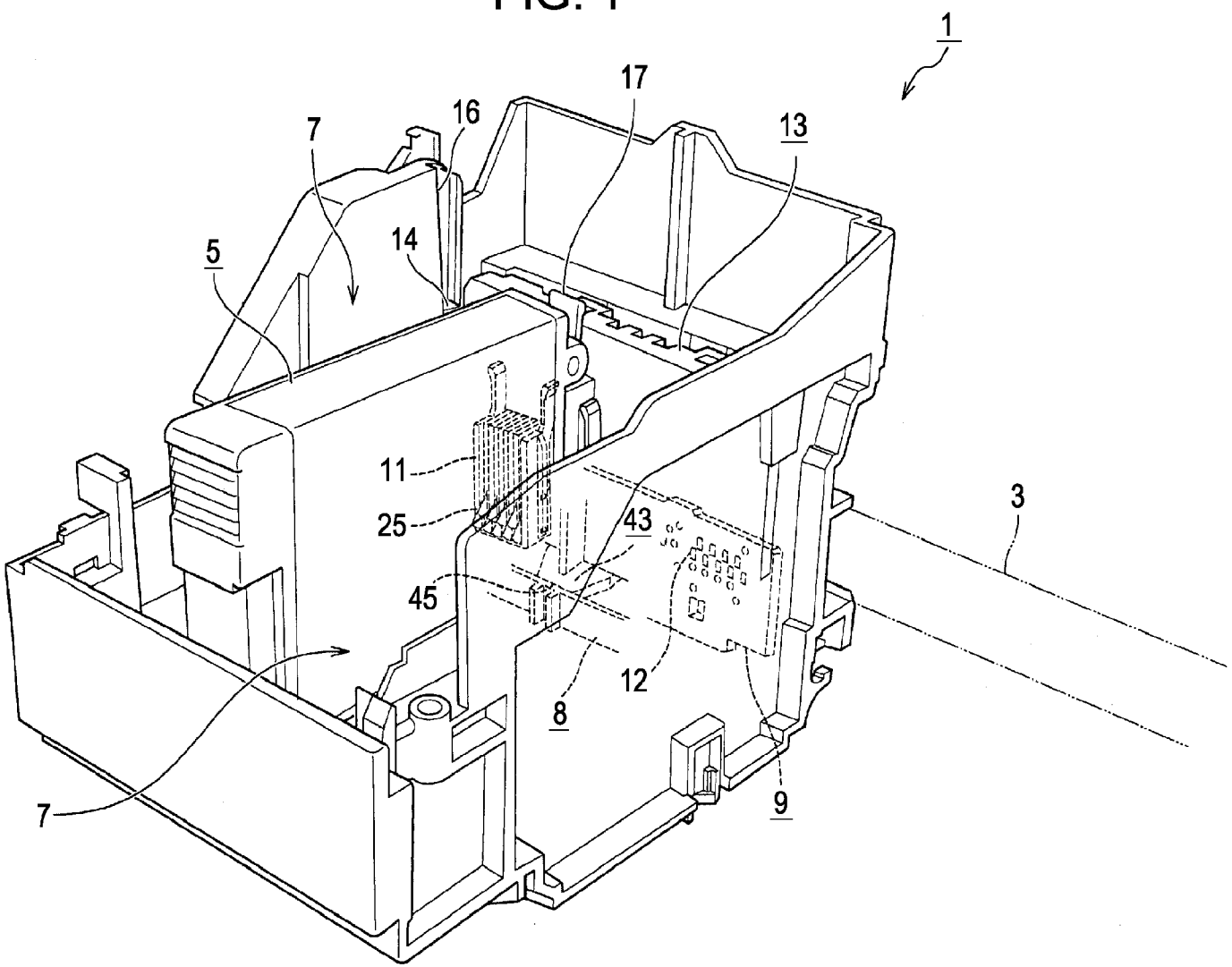
FIG. 1 is a perspective view of a carriage device for ink jet printers according to an embodiment of the invention.
Figure 2B:
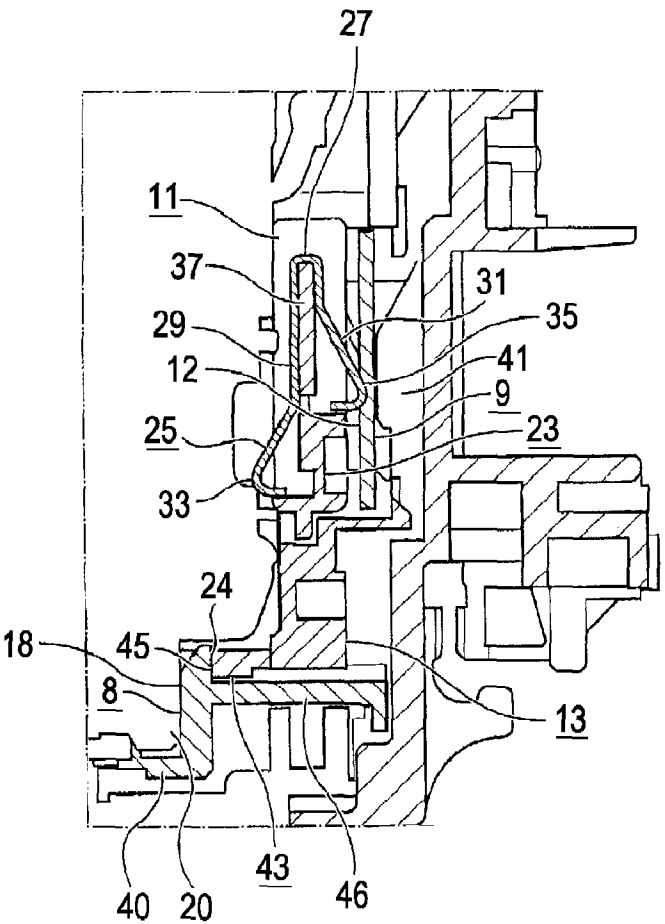
FIG. 2B is an enlarged side sectional view of the connector and a lower side thereof.
Figure 2A:
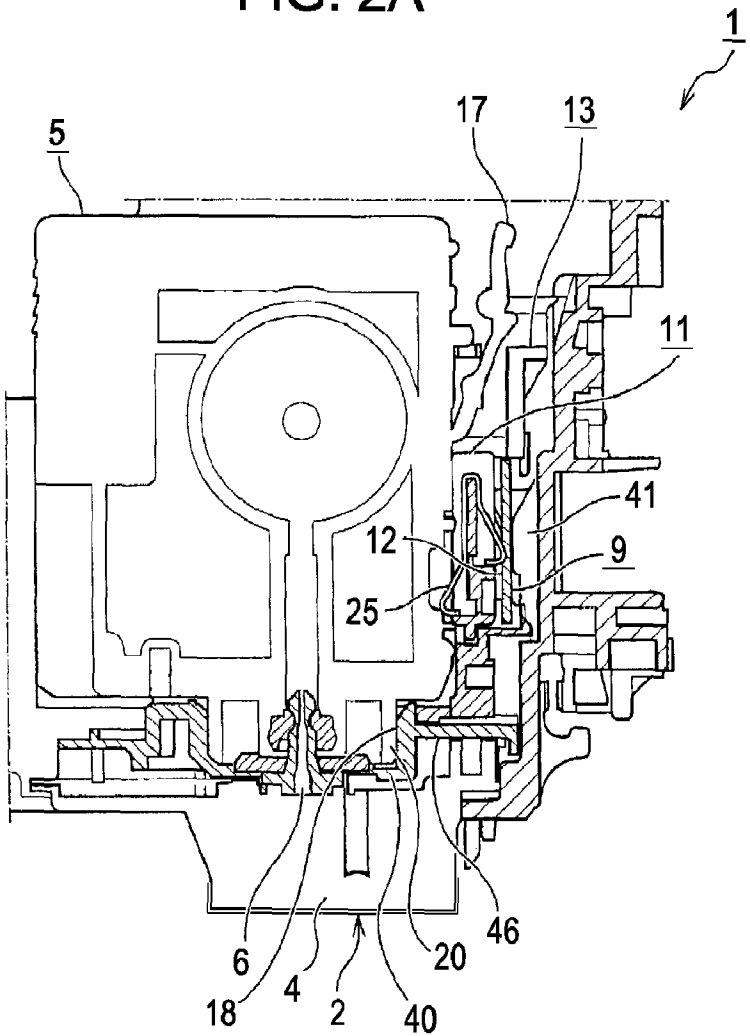
FIG. 2A is a side sectional view of a connector and the vicinity thereof according to an embodiment of the invention.
Figure 3:
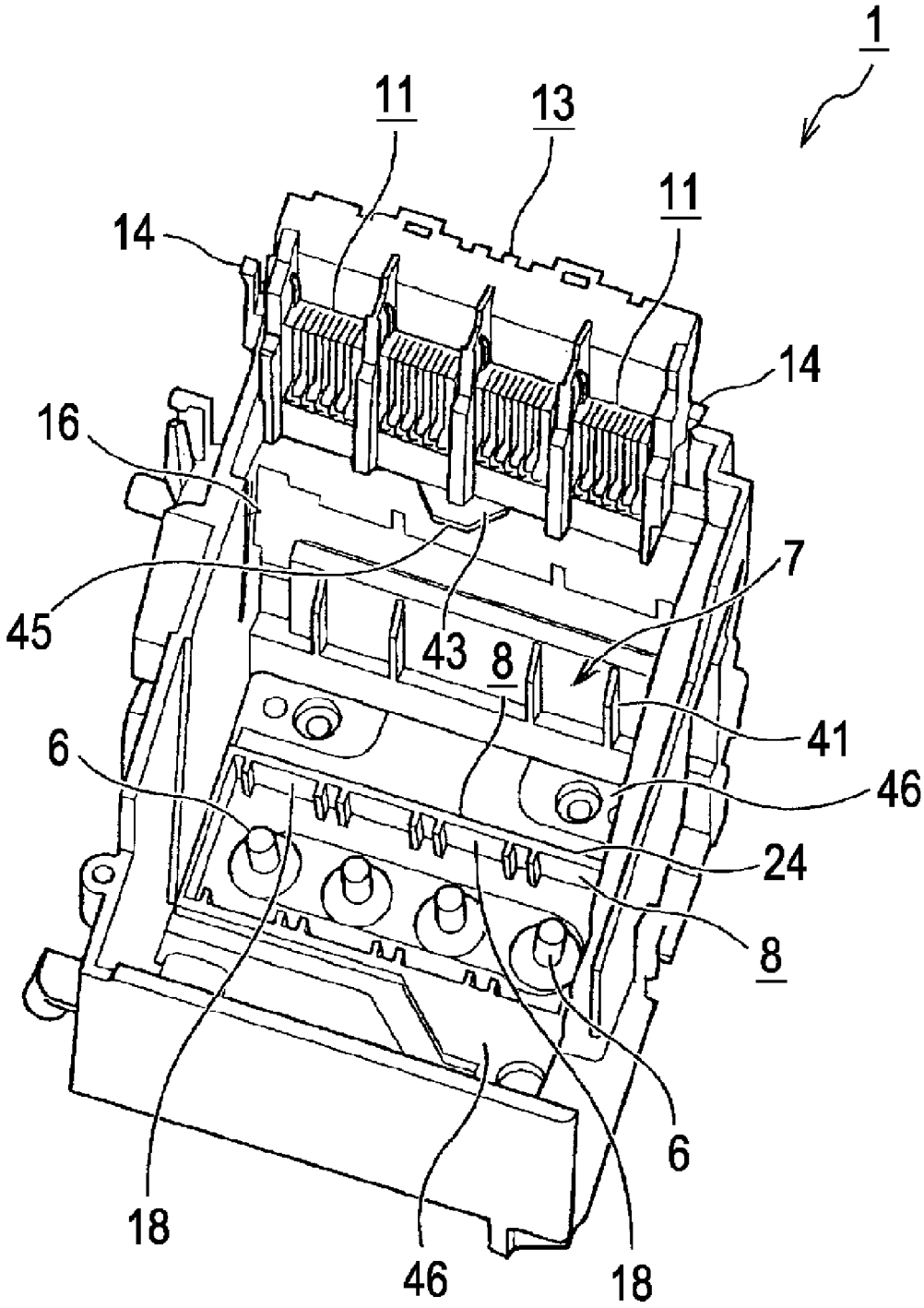
FIG. 3 is a perspective view of the inside of a carriage according to an embodiment of the invention at a time right before installment of a connector holder.
Figure 4:
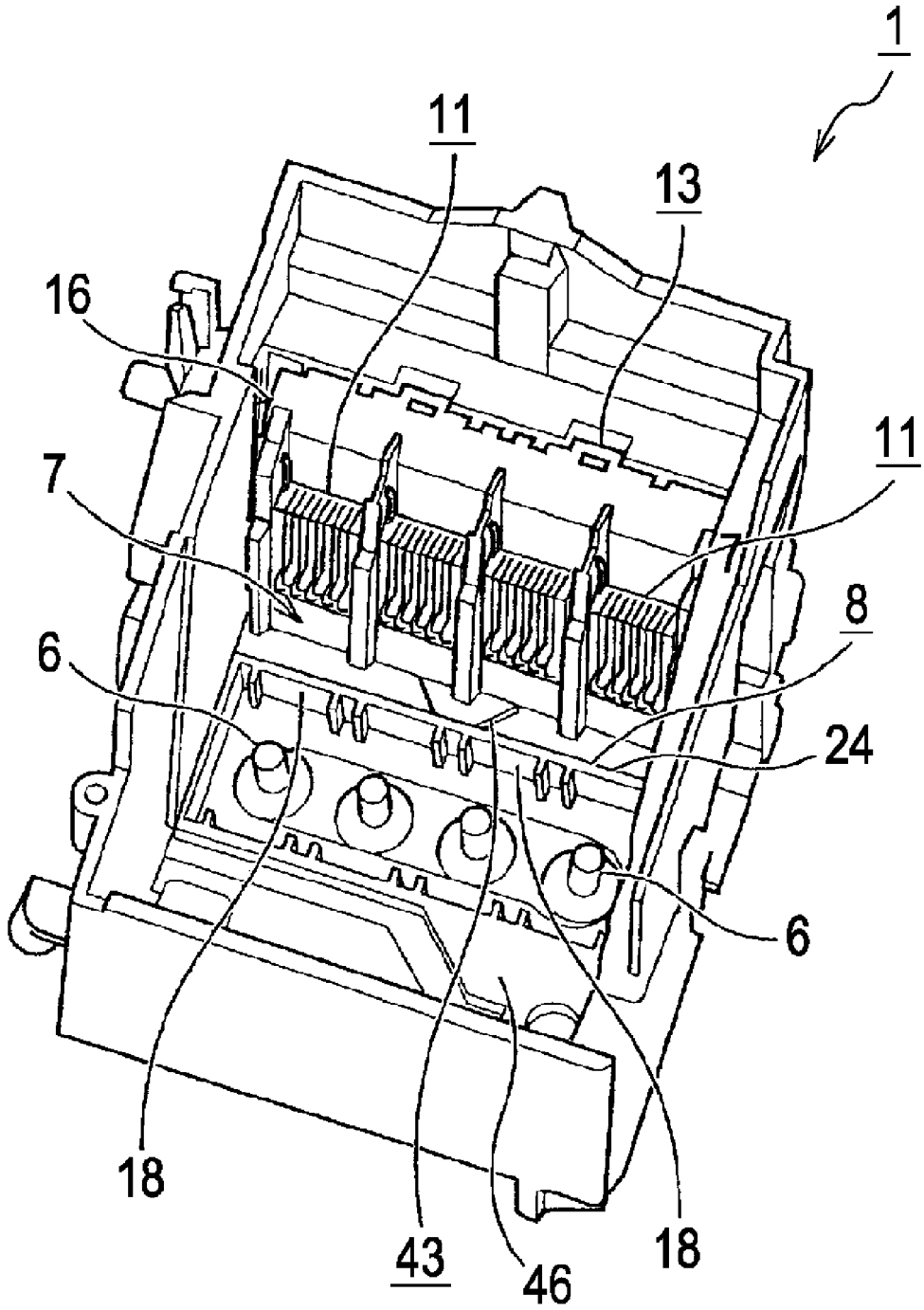
FIG. 4 is a perspective view of the inside of the carriage at a time when the connector holder is installed.
Figure 5:
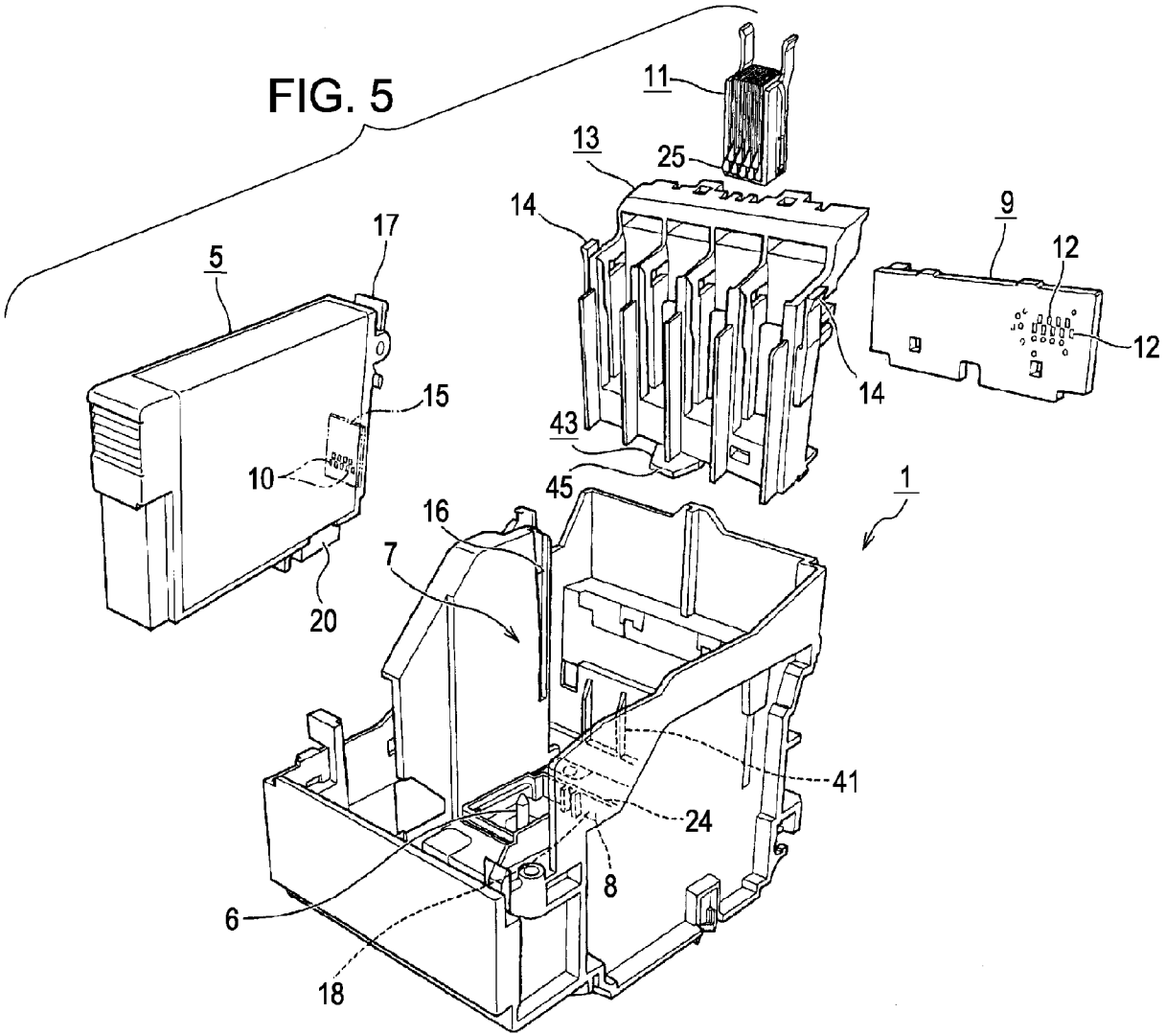
FIG. 5 is an exploded perspective view of constituent members neighbor to the connector holder according to an embodiment of the invention.
Figure 6:
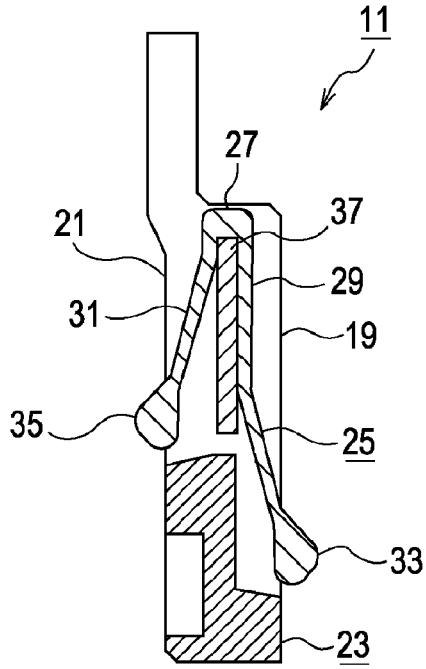
FIG. 6 is a longitudinal sectional view of a connector according to an embodiment of the invention.
Figure 7:
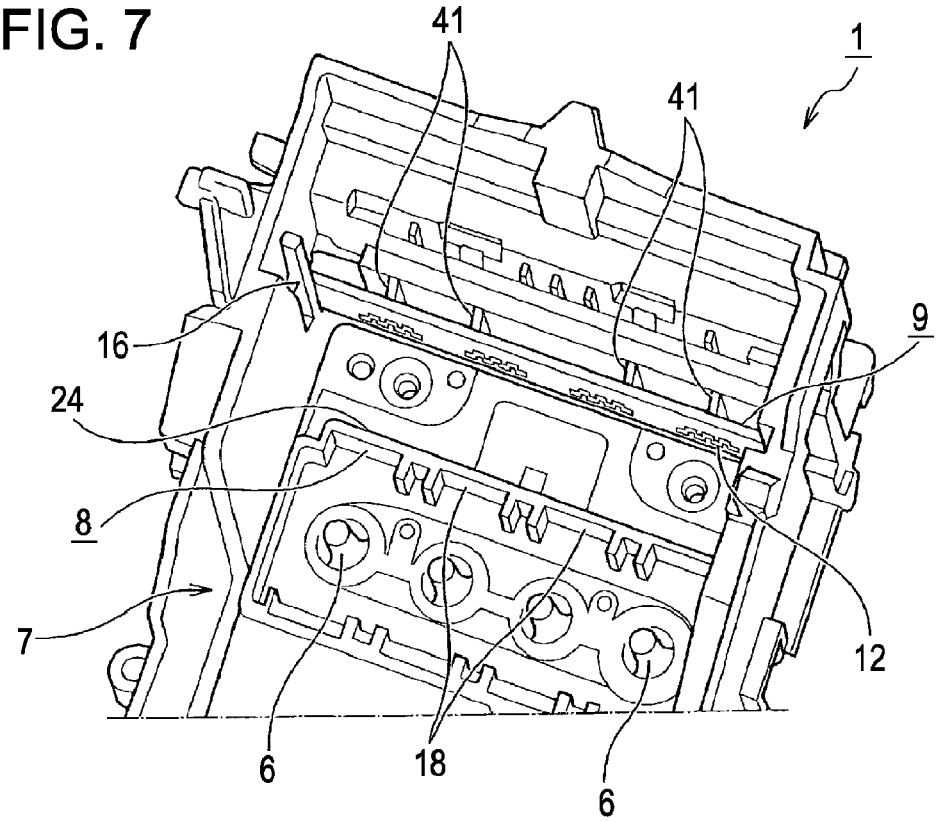
FIG. 7 is a perspective view of the inside of the carriage showing relationship between a circuit substrate and a back side support portion.
Figure 8:
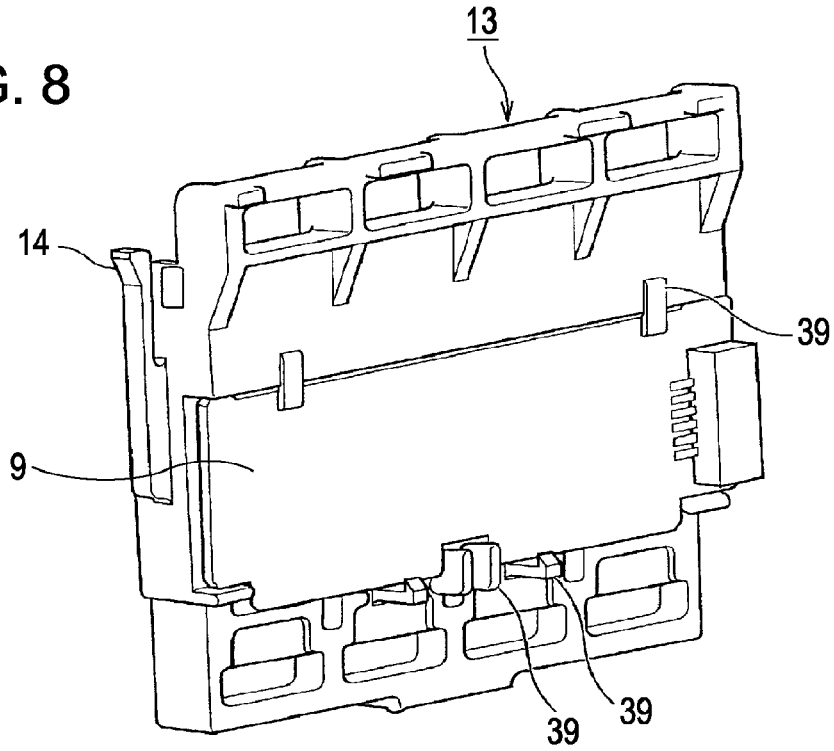
FIG. 8 is a perspective view of the back side of a connector holder according to an embodiment of the invention.
Figure 9:
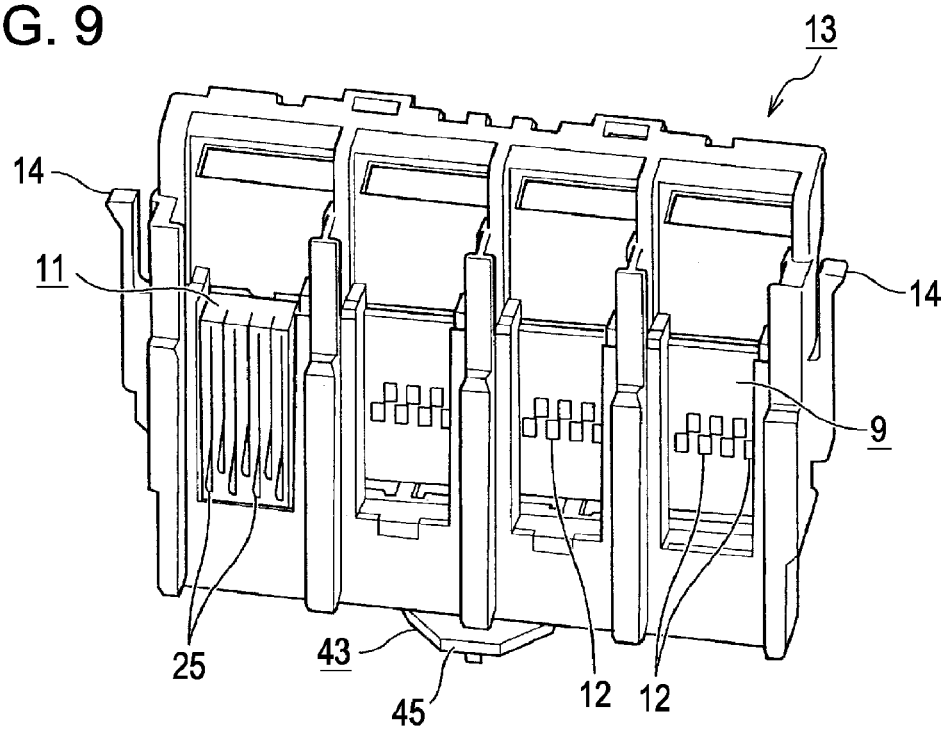
FIG. 9 is a perspective view of the front side of the connector.

Hereinafter, an embodiment of the present invention will be described with reference to the accompanying drawings. FIG. 1 is a perspective view of a carriage device for ink jet printers according to an embodiment of the invention. FIG. 2A is a side sectional view of a connector and the vicinity thereof according to an embodiment of the invention. FIG. 2B is an enlarged side sectional view of the connector and a lower side thereof. FIG. 3 is a perspective view of the inside of a carriage according to an embodiment of the invention at a time prior to installment of a connector holder. FIG. 4 is a perspective view of the inside of the carriage at a time when the connector holder is installed. FIG. 5 is an exploded perspective view of constituent members neighboring the connector holder according to an embodiment of the invention. FIG. 6 is a longitudinal sectional view of a connector according to an embodiment of the invention. FIG. 7 is a perspective view of the inside of the carriage showing a relationship between a circuit substrate and a back side support portion. FIG. 8 is a perspective view of the back side of a connector holder according to an embodiment of the invention. FIG. 9 is a perspective view of the front side of the connector.

FIG. 1 shows a carriage 1 and a recording head unit 2 (see FIGS. 2A and 2B) provided on the lower side of the carriage 1. The recording head unit 2 includes a head portion 4 having a nozzle array (not shown) for ejecting ink and a head base body 40 having a position determining portion 18 by which a position of an ink outlet portion 20 of an ink cartridge 5 is set and to which the head portion 4 is fixed. A wall portion 8 partitioning the position determining portion 18 of the head base body 40 is configured to serve as a supported portion 24 to be described later. The recording head unit 2 is fastened so as to be fixed to the carriage 1 through an outer base body portion 46 located on the outer side of the wall portion 8 of the head base body 40.

The carriage 1 can reciprocate along a carriage guide shaft or a carriage guide rail 3 in a direction perpendicular to a transport direction of a recording medium and performs recording on the recording medium. A plurality of cartridge receiving portions 7 for containing the ink cartridges 5 are formed. In a description below, a side facing a left-front corner of FIG. 1 is referred to as a front side of the carriage 1 and an opposite side thereto is referred to as a back side of the carriage 1. Sides of members attached to the carriage 1 will be referred to as front and back sides in accordance with the orientation in which they are disposed on the carriage 1.

On the back side of the carriage 1, a circuit substrate 9 (see FIGS. 2A and 2B) is provided, and a conductive connection portion 12 is formed on the circuit substrate 9. On a back side of an inner face of the carriage 1, connectors 11 are provided in correspondence with the cartridge receiving portions 7. The connectors 11 are held by connector holders 13 (FIG. 9 shows a status in which one connector 11 is held as an example). As shown in FIG. 3, the connector holder 13 is held by fitting both ends 14 of the connector holder 13 to a groove portion 16 of the carriage 1 using a sliding method. In this holding status, the connector holder 13 is configured to be located above the outer base body portion 46 inside the carriage 1. To be more specific, the recording head unit 2 and the connector holder 13 are configured to be assembled together so as to overlap each other in an assembly direction, whereby it is possible to decrease the size of the assembled carriage 1 in the depth direction thereof.

An inside bottom portion of the carriage 1 is constituted by the head base body 40 of the recording head unit 2. In this portion, ink supply openings 6 are formed so as to protrude in accordance with the cartridge receiving portions 7. An area around the ink supply openings 6 is defined by the protruding wall portion 8, and the inside of the partitioned area is configured to be the position determination portion 18 for determination of the position of the ink cartridge 5. In this embodiment, four position determining portions 18 are formed corresponding to the cartridge receiving portions 7. On a connector holder 13 side of the wall portion 8, that is, a wall face opposite the position determining portions 18 is formed to be a supported portion 24. The operation of the supported portion 24 will be described later.

In each ink cartridge 5, as shown in FIG. 5, a cartridge side substrate 15 is formed on a face facing the connector 11 and a locking lever 17 (see FIG. 1) used for fixing the ink cartridge 5 to the carriage 1 is provided above the cartridge side substrate 15. In addition, on the cartridge side substrate 15, conductive connection portions 10 (see FIG. 5, etc.) are formed. The ink cartridge 5 is configured to be fixed to the inside of the cartridge receiving portion 7 using snap fitting by slight and temporary elastic deformation of the locking lever 17 at a time when the ink cartridge 5 is pushed into the cartridge receiving portion 7.

The connector 11, as shown in FIG. 6, includes a first face 19 facing the cartridge side substrate 15 and a second face 21 facing the circuit substrate 9 that is provided on the back side of the carriage 1. The connector 11 allows conduction between the cartridge side substrate 15 and the circuit substrate 9 by being interposed therebetween. The connector 11, for example, has nine metal contacts 25 that are disposed parallel to one another for a housing 23 made of known materials. The nine contacts 25 are disposed in two lines to be in the same position every other line when viewed from the side, and contacts 25 adjacent to each other are disposed so as to be in different positions in the longitudinal direction of the housing 23 and are disposed in a zigzag pattern on the whole.

The contacts 25 have the same shape. Each contact 25 includes a first contact arm 29 that extends to the first face 19 side from a base end portion 27 and a second contact arm 31 that extends to the second face 21 side and is shorter than the first contact arm 29, as main frames. In front ends of the contact arms 29 and 31, contact terminals 33 and 35 in the shape of an approximate half circle are formed. The second contact arm 31 is formed shorter than the first contact arm 29. A base end portion 27 of each contact 25 is press-fitted to a thin plate-shaped portion 37 formed in the housing 23, whereby the contact 25 is supported by the housing 23.

The contact terminals 33 and 35 of the first and second contact arms 29 and 31 respectively protrude from the first and second faces 19 and 21, and the first and second contact arms 29 and 31 are configured to bend inward in the shape of a plate spring when load is applied to the contact terminals 33 and 35. By the action of the spring, the contact terminals 33 and 35 can tightly contact the conductive connection portion 10 of the cartridge side substrate 15 and the conductive connection portion 12 of the circuit substrate 9, and accordingly, electrical connection can be made assuredly.

Hereinafter, a configuration according to an embodiment of the invention will be described. As shown in FIG. 8, the circuit substrate 9 is held on the back side of the connector holder 13 by holding ribs 39. In a status that the connector holder 13 is set inside the carriage 1, as shown in FIG. 7 (the connector holder 13 is omitted in the figure for easy understanding), four back side support portions 41 having a shape of a rib formed inside the carriage 1 contact the back side of the circuit substrate 9 so as to prevent backward bending-like deformation of the circuit substrate 9. As described above, since a force for bending the circuit substrate 9 outward is applied when the contact terminals 33 and 35 tightly contact the conductive connection portion 10 of the cartridge side substrate 15 and the conductive connection portion 12 of the circuit substrate 9, the deformation of the circuit substrate 9 is prevented for maintaining electrical connection assuredly by regulating the bending of the circuit substrate 9.

As shown in FIG. 9, in a bottom portion of the front side, that is, the ink cartridge 5 side of the connector holder 13, a deformation preventing support portion 43 is formed. The deformation preventing support portion 43 is provided as a convex portion around the center of the connector holder 13. The deformation preventing support portion 43 has a trapezoid shape, and a shorter side of the trapezoid is formed as a support face 45. As shown in FIG. 4, the dimensions of the deformation preventing support portion 43 are set such that the support face 45 contacts the supported portion 24 formed on the connector holder 13 side of the wall portion 8 when the connector holder 13 is set inside the carriage 1.

As described above, since the deformation preventing support portion 43 is configured to contact the supported portion 24 provided inside the carriage 1 when the connector holder 13 is set inside the carriage 1, the following advantages can be obtained.

Since a force for bending the circuit substrate 9 outward is suppressed by the back side support portion 41 when the contact terminals 33 and 35 tightly contact the conductive connection portion 10 of the cartridge side substrate 15 and the conductive connection portion 12 of the circuit substrate 9, the connector holder 13 tends to bend toward the ink cartridge 5 side as a counteraction thereof. However, since the deformation preventing support portion 43 contacts the supported portion 24, the connector holder 13 can continuously maintain its original form without being bent toward the ink cartridge 5 side. Thus, deformation of the circuit substrate 9 on the basis of the deformation of the connector holder 13 can be suppressed, and accordingly, it is possible to maintain a status of excellent connection between the contact terminals 33 and 35 and the conductive connection portions 10 and 12.

In particular, when the ink cartridge 5 is in a status of being detached from the cartridge receiving portion 7, elastic contact between the conductive connection portion 10 of the ink cartridge 5 and the connector 11 disappears, and thus, a force for reducing the deformation of the connector holder 13 toward the ink cartridge 5 side disappears from that portion. In this embodiment of the invention, even in such a case, the deformation of the connector holder 13 is suppressed by using a structure to bring the support portion 43 into contact with the supported portion 24.

In addition, since the wall portion 8 partitioning the position determining portion 18, at which the ink outlet portion 20 of the ink cartridge 5 is set and positioned, is configured to serve as the supported portion 24, that is, both wall faces of inner and outer wall faces of the wall portion 8 partitioning the position determining portion 18 of the head base body 40 perform a position determining function of the ink cartridge 5 and a deformation preventing function of the connector holder 13, the contact distance and contact pressure between the conductive connection portion 10 of the ink cartridge 5 and the connector 11 can be adjusted with high precision.

While an embodiment of the invention has been described, however, various modified examples thereof can be used. For example, in the embodiment described above, the deformation preventing support member 43 has a shape of one trapezoid, but the deformation preventing support member 43 may have a different shape or a plurality of deformation preventing support members 43 may be formed in the connector holder 13, as long as the deformation preventing support member 43 has the above-described function. In addition, although the deformation preventing support member 43 is formed on the bottom portion of the connector holder 13 in the above-described embodiment, the deformation preventing support member 43 and the supported portion 24 may be formed in a position other than the bottom portion when the supported portion 24 to be contacted by the deformation preventing support member 43 can be provided inside the carriage 1.

In the above-described embodiment, although an ink jet printer as a recording apparatus is described as an example, the present invention may be applied to a liquid ejecting apparatus that causes liquid to adhere onto a medium, corresponding to the recording medium in the above described recording apparatus, by ejecting liquid selected depending on the use of the apparatus in place of ink onto the medium from a liquid ejecting head corresponding to the above-described ink jet recording head.

The entire disclosure of Japanese Patent Application No: 2006-173001, filed Jun. 22, 2006 are expressly incorporated by reference herein.

What is claimed is:

1. A carriage device comprising:

a circuit substrate having a conductive connection portion;

a connector having a plurality of contact arms;

a connector holder in which the circuit substrate and the connector are installed; and a carriage in which a recording head unit is built and an ink cartridge having a conductive connection portion is housed and to which the connector holder is attached with both ends of the connector holder held, wherein contact terminals of the plurality of contact arms of the connector elastically contact the conductive connection portion of the circuit substrate and the conductive connection portion of the ink cartridge which are respectively disposed on both sides of the connector so as to electrically conduct between the circuit substrate and the ink cartridge, wherein a back side support member contacting the circuit substrate for regulating deformation of a face of the circuit substrate on the basis of the elastic contact is provided in the carriage, and wherein a deformation preventing support member is formed on a side opposite a side, on which the circuit substrate is installed, of the connector holder and the deformation preventing support member is configured to be able to contact a supported portion formed inside of the carriage.

2. The carriage device according to claim 1, wherein the plurality of contact arms comprises a first contact arm protruding from a first side that faces a cartridge side of the substrate and a second contact arm protruding from a second side that faces the circuit substrate provided on a back side of the carriage.

3. The carriage device according to claim 2, wherein, in the connector holder, contact terminals in the shape of a half circle are provided in front ends of the plurality of contact arms, and wherein the length of the second contact arm is formed to be shorter than that of the first contact arm.

4. The carriage device according to claim 3, wherein the deformation preventing support member is formed in a convex portion, which is provided in a part having a large deformation amount, in a width direction of the connector holder.

5. The carriage device according to claim 3, wherein the recording head unit comprises a head portion having a nozzle array for ejecting ink and a head base body having a position determining portion to which the head portion is fixed and at which an outlet portion of the ink cartridge is set and positioned, and wherein a wall portion partitioning the position determining portion of the head base body is configured to serve as the supported portion.

6. The carriage device according to claim 5, wherein the recording head unit is fastened to be fixed to the carriage through an outer base body portion located in the outside of the wall portion of the head base body and the connector holder is configured to be positioned above the outer base body portion inside the carriage.

7. A recording apparatus comprising:

a transport unit transporting a recording medium and a recording unit performing recording on the recording medium that is transported by the transport unit, wherein the recording unit includes a carriage device having a carriage that reciprocates in a main scanning direction which is perpendicular to a transport direction of the recording medium, and wherein the carriage device is the carriage device according to claim 1.

* * * * *